US010186188B2

(12) United States Patent
Blanco et al.

(10) Patent No.: US 10,186,188 B2
(45) Date of Patent: Jan. 22, 2019

(54) MULTI-ANGLE SIMULTANEOUS VIEW LIGHT-EMITTING DIODE DISPLAY

(71) Applicant: MOTOROLA SOLUTIONS, INC., Schaumburg, IL (US)

(72) Inventors: Alejandro G. Blanco, Fort Lauderdale, FL (US); Scott H. Richards, Plantation, FL (US); Chi T Tran, Weston, FL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 532 days.

(21) Appl. No.: 14/862,534

(22) Filed: Sep. 23, 2015

(65) Prior Publication Data

US 2017/0084221 A1 Mar. 23, 2017

(51) Int. Cl.
*G09G 3/32* (2016.01)

(52) U.S. Cl.
CPC ..... *G09G 3/32* (2013.01); *G09G 2320/028* (2013.01)

(58) Field of Classification Search
CPC . G09G 3/32; G09G 2320/068; G09G 2354/00
See application file for complete search history.

(56) References Cited

U.S. PATENT DOCUMENTS 8,363,325 B2 1/2013 Kuhlman et al.
2009/0058845 A1* 3/2009 Fukuda ..... B60K 35/00 345/214
2011/0157264 A1* 6/2011 Seshadri ..... G06F 3/14 345/698
2012/0056879 A1* 3/2012 Song ..... H04N 13/305 345/419
2012/0062999 A1* 3/2012 Kuhlman ..... H04N 13/0404 359/639
2013/0215101 A1* 8/2013 Duan ..... G09G 5/32 345/419
2016/0349790 A1* 12/2016 Connor ..... G06F 1/1694

OTHER PUBLICATIONS

First Office Action from the State Intellectual Property Office of China for Application No. 201610849511.X dated Oct. 12, 2018 (17 pages).

* cited by examiner

*Primary Examiner* — Carolyn R Edwards
(74) *Attorney, Agent, or Firm* — Michael Best & Friedrich LLP

(57) ABSTRACT

A method and apparatus are described for providing simultaneous display views from a display of a portable electronic device at multiple angles. The display includes a first set of light-emitting diodes positioned in a display field and oriented to produce a first visual data depiction viewable at a first perspective angle. The display also includes a second set of light-emitting diodes co-positioned in the display field with the first set of light-emitting diodes, oriented to produce a second visual data depiction viewable at a second perspective angle, and oriented to make the second visual data depiction non-viewable from the first perspective angle. The second perspective angle is different than the first perspective angle and the second visual data depiction is different than the first visual data depiction.

16 Claims, 7 Drawing Sheets

MULTI-ANGLE SIMULTANEOUS VIEW LIGHT-EMITTING DIODE DISPLAY

BACKGROUND OF THE INVENTION

Some portable devices, such as land mobile radios, have displays mounted on a front vertical surface of the device housing. When such portable devices are worn by a user, for example on a belt, a front display might be visible by others with limited visibility to the user. In some portable devices, a second smaller display is provided on a top surface of the device housing to provide some limited information to the user while the portable device is worn. However, the inclusion of such a second display on the top surface necessitates a certain minimum thickness of the portable device and, therefore, limits reduction of the size of the housing.

Accordingly, there is a need for a multi-angle simultaneous view display.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
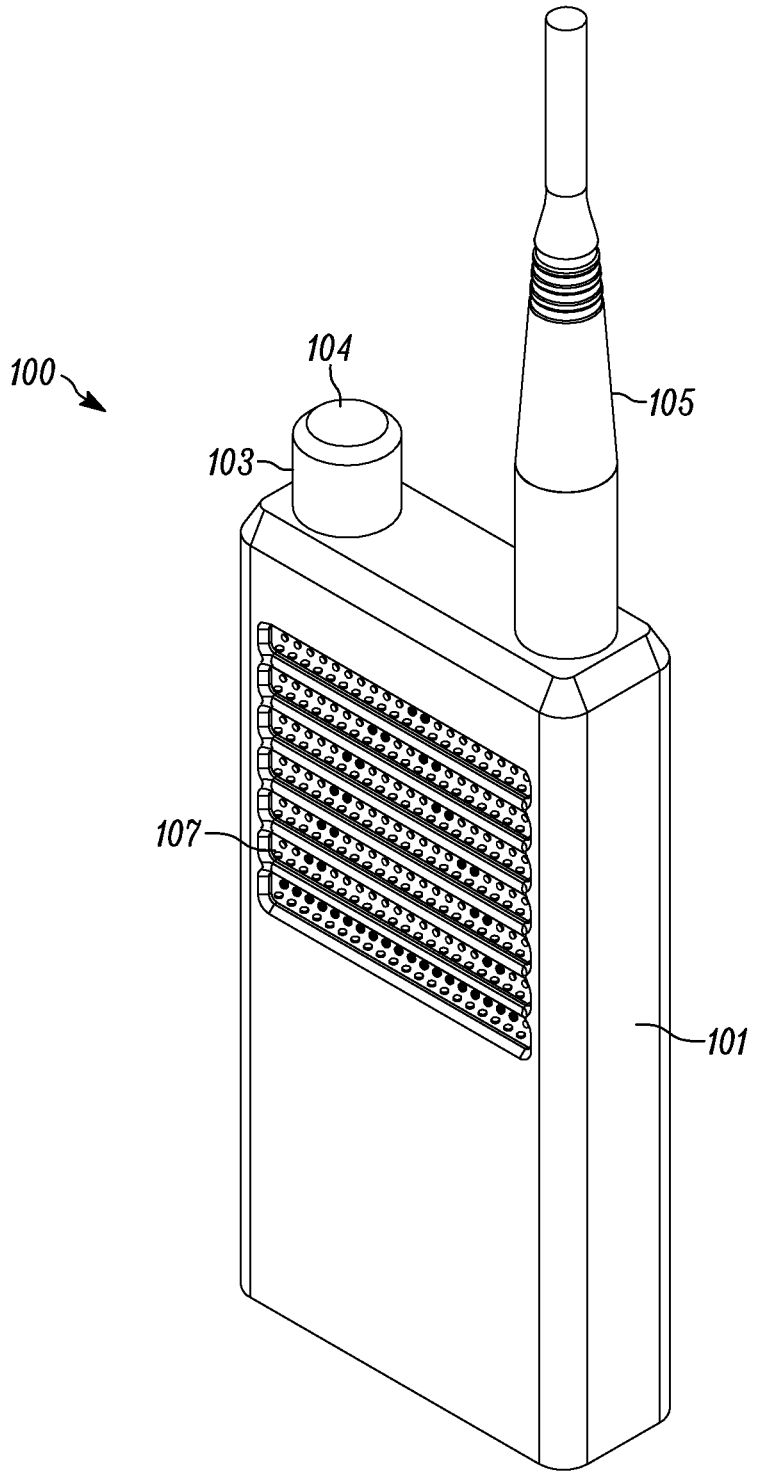
FIG. 1 is a perspective view of a portable radio in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

One embodiment provides a display for a portable electronic device. The display includes a first set of light-emitting diodes positioned in a display field and oriented to produce a first visual data depiction viewable at a first perspective angle. The display also includes a second set of light-emitting diodes co-positioned in the display field with the first set of light-emitting diodes, oriented to produce a second visual data depiction viewable at a second perspective angle, and oriented to make the second visual data depiction non-viewable from the first perspective angle. The second perspective angle is different than the first perspective angle and the second visual data depiction is different than the first visual data depiction.

In some embodiments, the first set of light-emitting diodes are arranged as a first two-dimensional array across the display field and the second set of light-emitting diodes are intermingled with the first set of light-emitting diodes across the display field and arranged in a second two-dimensional array.

Furthermore, in some embodiments, the display includes a first plurality of carrier strips arranged in parallel across the display field. Each carrier strip of the first plurality of carrier strips supports a first defined number of linearly-arranged light-emitting diodes from the first plurality of light-emitting diodes. A second plurality of carrier strips are arranged alternatingly with the first plurality of carrier strips across the display field. Each carrier strip of the second plurality of carrier strips supports a second defined number of linearly-arranged light-emitting diodes from the second plurality of light-emitting diodes. Each carrier strip of the second plurality of carrier strips is positioned at an angle relative to a neighboring one of the first plurality of carrier strips. The angle of each carrier strip of the second plurality of carrier strips provides the orientation of the second set of light-emitting diodes.

FIG. 1 shows an example of a portable electronic device—specifically a portable radio 100. The radio 100 includes a device housing 101 that is generally rectangular cuboid in shape. A rotatable dial control 103 is mounted on a top horizontal surface of the device housing 101 and a push-button control 104 is positioned with an activation axis that is co-linear with a rotational axis of the rotatable dial control 103. An antenna 105 is also positioned on the top horizontal surface of the device housing 101. A display 107 is positioned on the front vertical surface of the device housing 101. FIG. 1 provides one example of a radio 100 and other implementations can include more, fewer, or different components.

Figure 2:
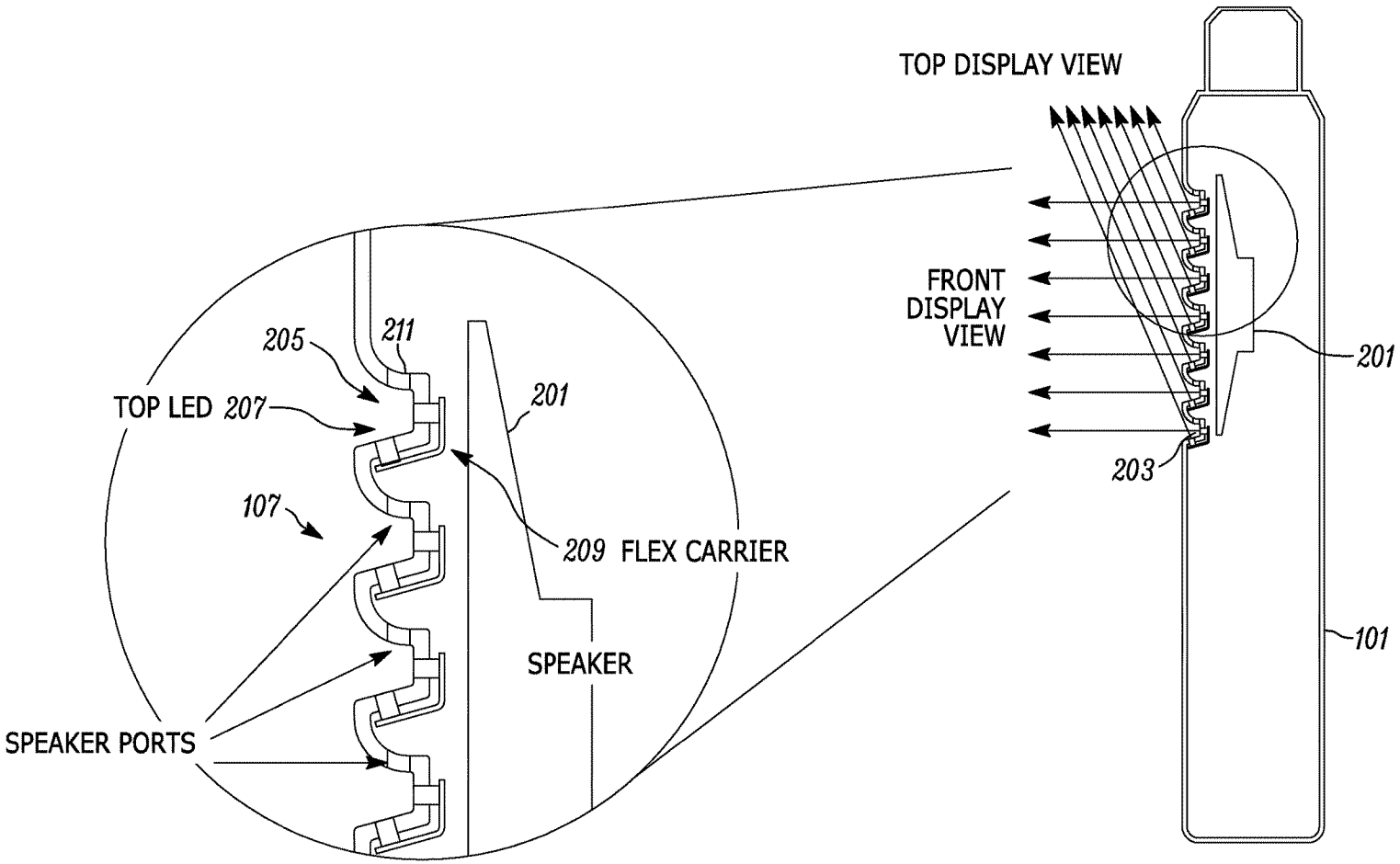
FIG. 2 is a cross-sectional view of the portable radio of FIG. 1 in accordance with some embodiments.

As shown in the cross-sectional illustration of FIG. 2, the radio 100 also includes a speaker 201 mounted inside the device housing 101 behind the display 107. The display 107 includes a plurality of parallel horizontal trenches 203. As illustrated in detail in the insert, a linear array of front-facing light-emitting diodes 205 are arranged along a vertical back surface of each horizontal trench 203. Similarly, a linear array of upward-facing light-emitting diodes 207 is arranged along an angled lower surface of each horizontal trench 203. The front-facing light-emitting diodes 205 and the upward-facing light-emitting diodes 207 are mounted on and supported by one or more flex carrier strips positioned within the device housing 101 as described in further detail below. A series of speaker port holes 211 are formed on an upper surface of each horizontal trench 211 and allow for acoustic vibrations (i.e., sounds generated by the speaker 201) to pass through the display 107. Again, FIG. 2 provides one example of a radio 100 and, in some other implementations, a speaker is not mounted behind the display 107 and speaker port holes 211 are not integrated into the display 107.

This arrangement of light-emitting diodes provides a two-dimensional array of front-facing light-emitting diodes 205 that together produce a "front display view" that is viewable from a first range of angles including, for example, a first angle that is normal to the front surface of the device housing 101. It also provides a two-dimensional array of upward-facing light-emitting diodes 207 that together produce a "top display view" that is viewable from a second range of angles including, for example, a second angle from above the device housing 101. The top display view is oriented to be viewable by the user while wearing the device housing 101 (e.g., on the belt or on the chest of the user). The front display view is primarily viewable by the user when handling the device housing 101 and is viewable by others when the device housing 101 is being worn by the user.

Figure 3:
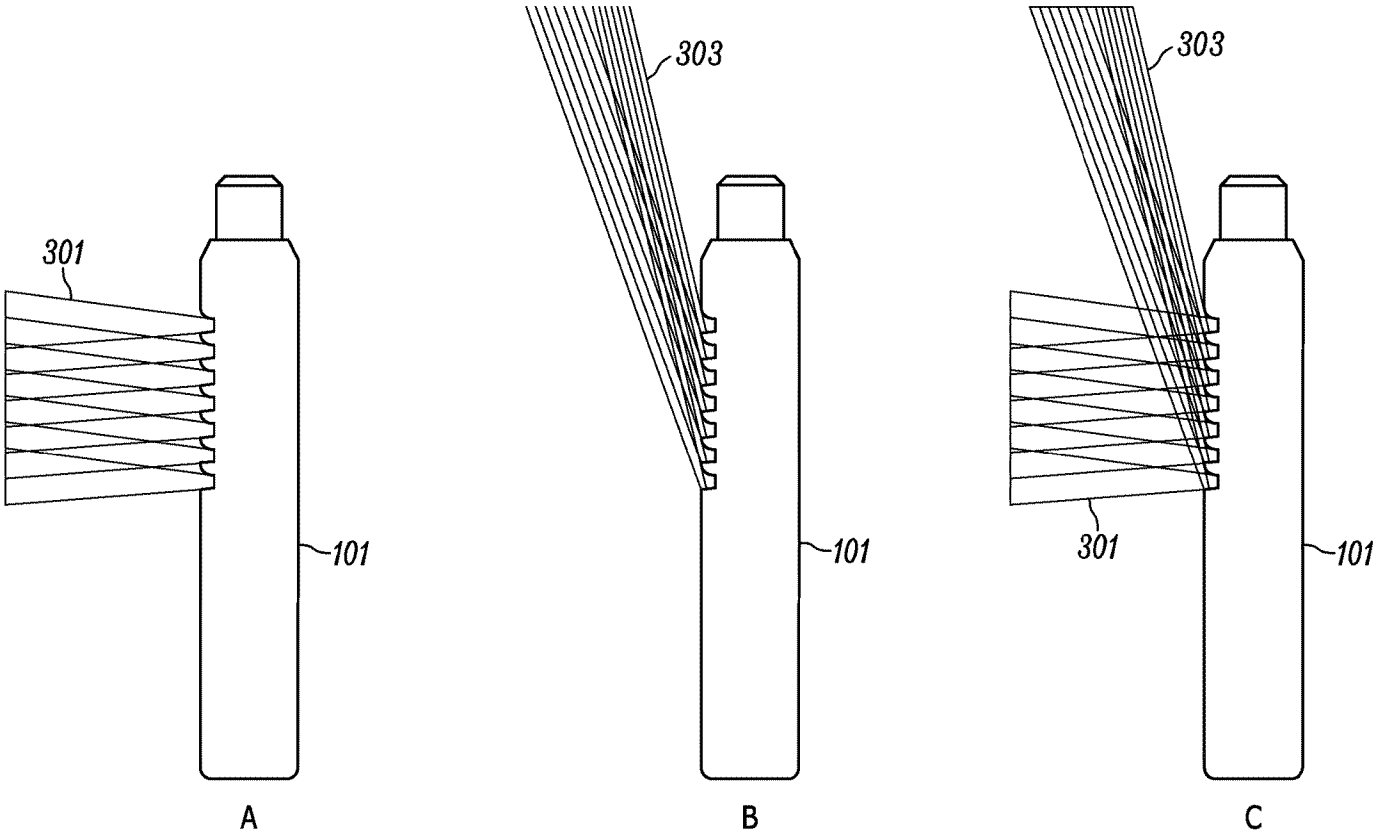
FIG. 3 is a series of side views of the portable radio of FIG. 1 illustrating various display modes in accordance with some embodiments.

As further illustrated in FIG. 3, the display can be configured to selectively utilize only the two-dimensional array of the front-facing light-emitting diodes 205 to provide only the front display view 301 (as illustrated in Example A) and to selectively utilized only the two-dimensional array of upward-facing light-emitting diodes 207 to provide only the top display view 303 (as illustrated in Example B). The display can be further configured to utilize both the front-facing light-emitting diodes 205 and the upward-facing light-emitting diodes 207 to simultaneously provide both the front display view 301 and the top display view 303.

Figure 4A:
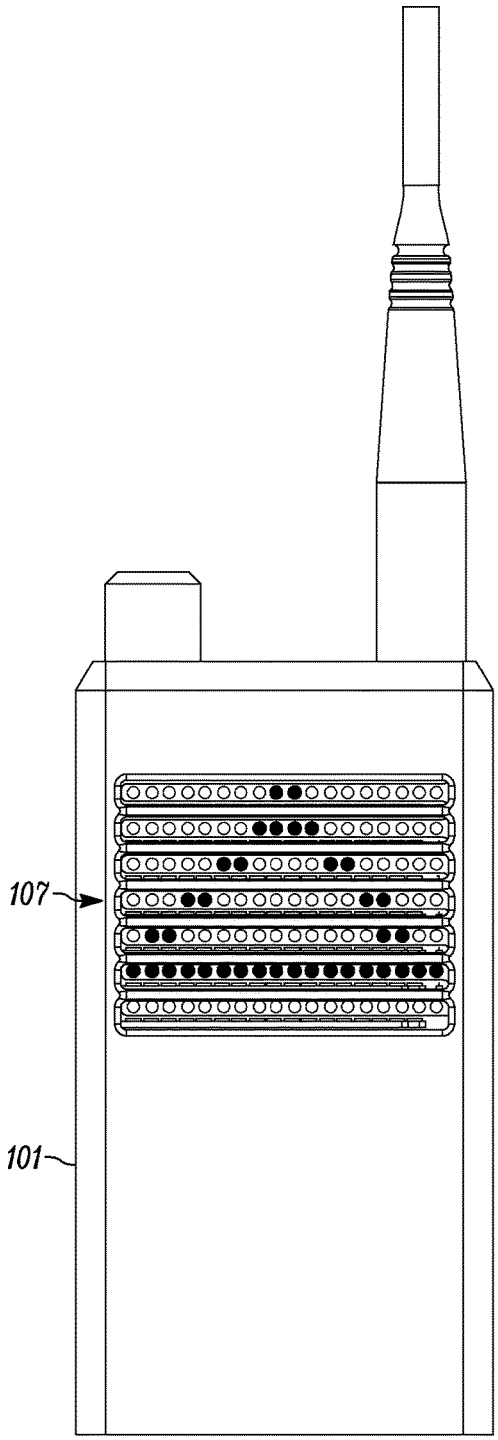
FIG. 4A is an elevation view of the portable radio of FIG. 1 illustrating display information viewable from a first perspective in accordance with some embodiments.
Figure 4B:
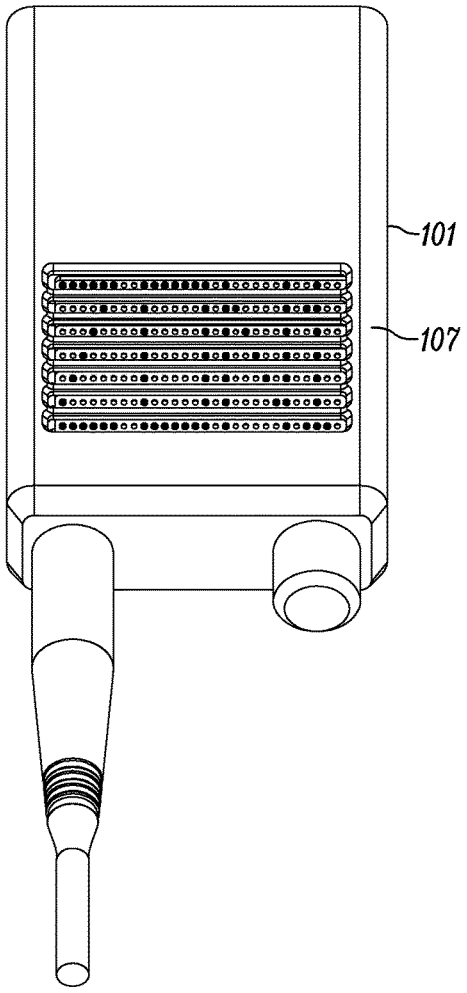
FIG. 4B is a perspective view of the portable radio of FIG. 1 illustrating display information shown simultaneously with the displaying information of FIG. 4A and viewable from a second perspective angle in accordance with some embodiments.

In some situations and configurations, the display 107 may be configured to provide the same display output on both the front display view 301 and the top display view 303 simultaneously. However, in other situations and configurations, the display 107 may be configured to provide a first display output on the front display view 301 while providing a different display output on the top display view 303. For example, as illustrated in FIG. 4A, when the device housing 101 is viewed from the front (i.e., an angle normal to the front vertical surface of the device housing 101), the display 107 shows a triangle shape (as illustrated in Example A). At the same time, when the device housing 101 is viewed from an angle above the device housing (as illustrated in FIG. 4B), the display 107 shows the word "ZONE."

Figure 5B:
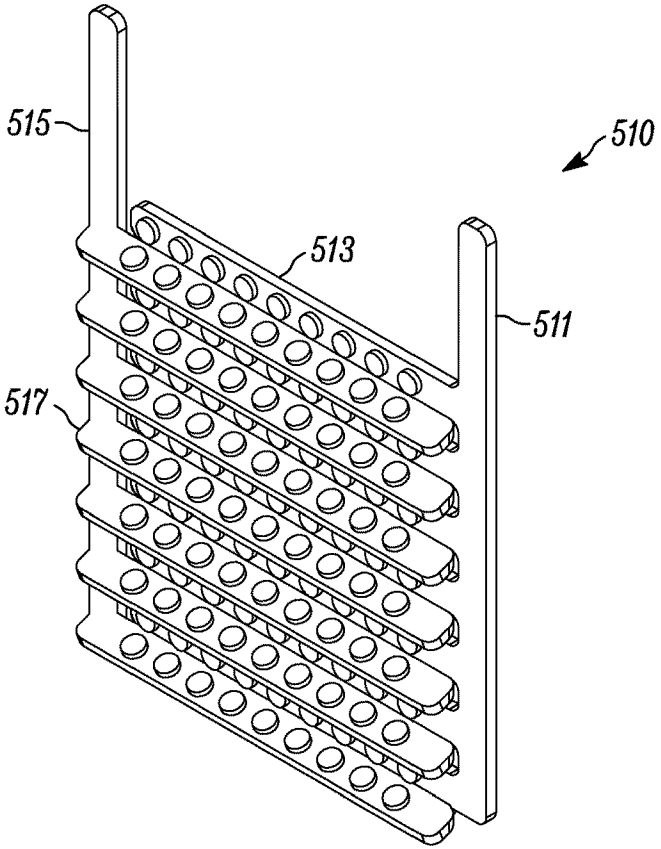
FIG. 5B is a perspective view of another flex carrier supporting light-emitting diode arrays in the portable radio of FIG. 1 in accordance with some embodiments.
Figure 5A:
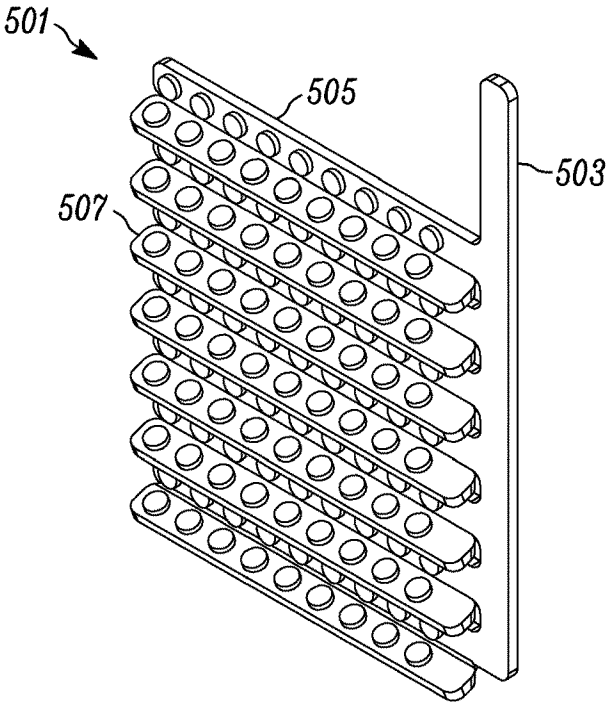
FIG. 5A is a perspective view of a flex carrier supporting light-emitting diode arrays in the portable radio of FIG. 1 in accordance with some embodiments.

FIGS. 5A and 5B illustrate two examples of carrier strip arrangements that can be used to support, position, and orient the light-emitting diodes as discussed above in reference to FIG. 2. In the example of FIG. 5A, a carrier 501 includes a series of horizontally arranged carrier strips all coupled to a single support structure 503. The front-facing light-emitting diodes are mounted on carrier strips 505 that are directly coupled to the support structure 503. The upward-facing light-emitting diodes are mounted on carrier strips 507 that are arranged alternatingly with the front-facing carrier strips 505. Each upward facing carrier strip 507 is coupled to a neighboring front-facing carrier strip 505 and oriented at an angle relative to the neighboring carrier strip 505. Electronic traces are formed on the support structure 503 to carrying signals that control selective activation of each light-emitting diode mounted on either a front-facing carrier strip 505 or an upward-facing carrier strip 507.

In the example of FIG. 5B, a carrier 510 also includes a first support structure 511 provided along a side of the display. However, only the front-facing carrier strips 513 are coupled to and supported by the first support structure 511. A second support structure 515 is provided on the opposite side of the display. The upward-facing carrier strips 517 are again arranged alternatingly with the front-facing carrier strips 513 and each is oriented at an angle relative to its neighboring front-facing carrier strip 513. However, each upward-facing carrier strip 517 is coupled to and supported by the second support structure 515. As such, the carrier arrangement 510 includes two physically separate structures—one providing the two-dimensional array of front-facing light-emitting diodes and the other providing the two-dimensional array of upward-facing light-emitting diodes. Accordingly, signals that control the selective activation of the front-facing light-emitting diodes are communicated through electronic traces formed on the first support structure 511 while signals that control selective activation of the upward-facing light-emitting diodes are communicated through electronic traces formed on the second support structure 515.

Figure 6:
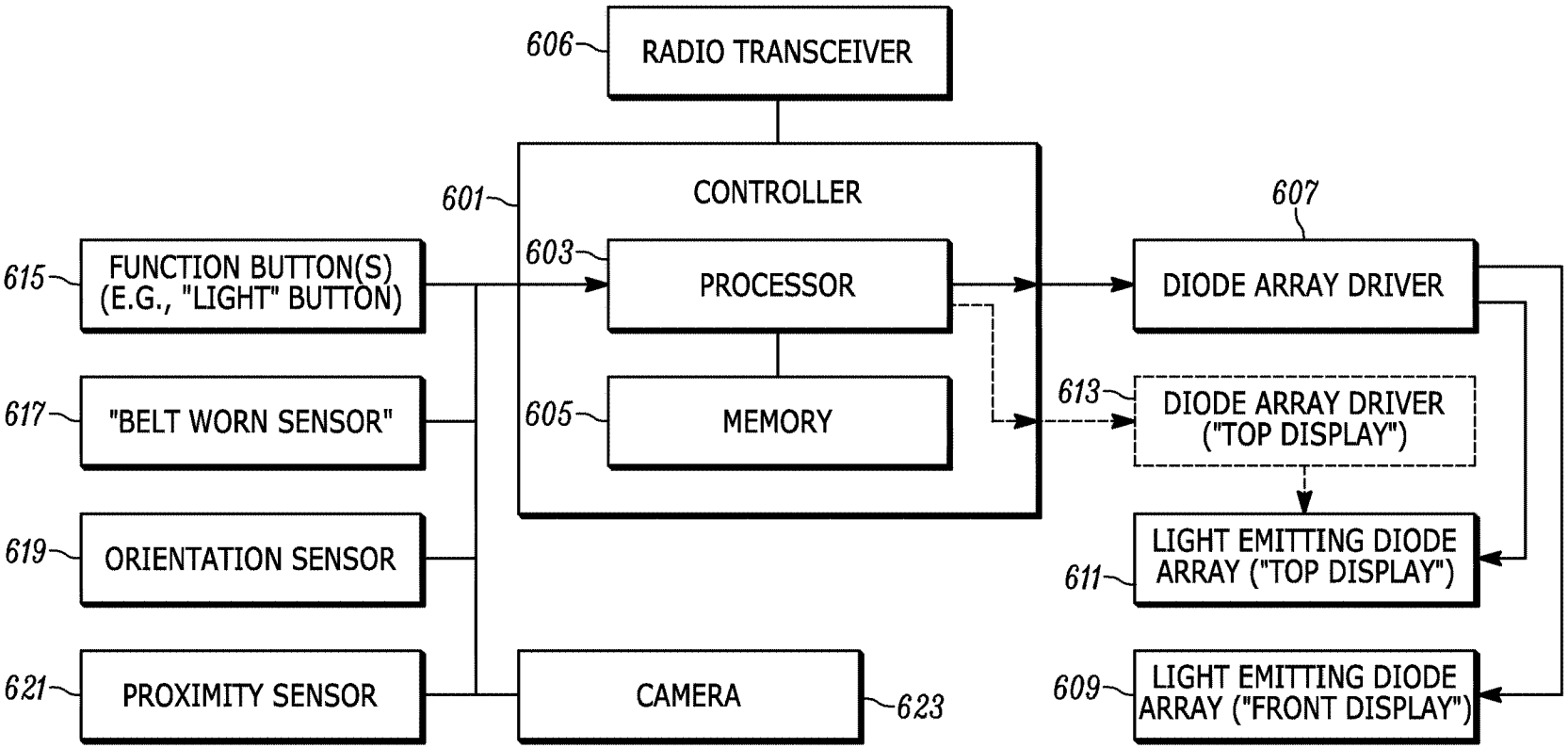
FIG. 6 is a block diagram of a display system for the portable radio of FIG. 1 in accordance with some embodiments.

FIG. 6 provides a block diagram of one example of a control system for a display such as those described above. A controller 601 includes a processor 603 and a computer-readable, non-transitory memory 605. The memory 605 stores data and instructions that are accessed and executed by the processor 603 to provide various functions. The controller 601 communicates with a radio transceiver 606 that provide the audio communication functionality of the portable radio. To control the operation of the display, the controller 601 provides an output signal to a diode array driver 607 which, in turn, controls the selective activation of the front-facing light-emitting diodes 609 of the front display view and the upward-facing light-emitting diodes 611 of the top display view. In some embodiments, a single diode array driver 607 is used to control the operation of all of the diodes in the display. However, some embodiments include a second diode array driver 613. In such embodiments, the controller 601 sends display information for the front display view to the first diode array driver 607 which, in turn, controls the operation of only the front-facing light-emitting diodes 609 and sends display information for the top display view to the second diode array driver 613 which, in turn, controls the operation of only the upward-facing light-emitting diodes 611.

In some embodiments, the controller 601 is configured to monitor one or more sensors or controls to determine certain usage state information for the electronic device and to determine appropriate display information based on the usage state. For example, as illustrated in FIG. 6, the controller 601 can be communicative coupled to a function button 615, a belt worn sensor 617, an orientation sensor 619, a proximity sensor 621, and a camera 623.

The function button 615 (e.g., button 104 in FIG. 1) can be selectively pressed by the user to cause a function to be performed or to cause certain information to be displayed. For example, in some embodiments, pressing the function button 615 causes the controller to turn on all of the front-facing light-emitting diodes at high power so that the front display view can be used as a flash light. In other implementations, device can also include one or more other user interface elements in addition to or instead of the function button 615. For example, the device can include a touchscreen display that causes a function to be performed or certain information to be displayed. As such, the operation associated with the "function button" 615 herein is not necessarily limited to a button that is pressed.

The belt worn sensor 617 can include, for example, a contact sensor that sends a signal indicating whether a belt clip is in contact with a base (the physical connection is broken when the device is attached to a belt by a belt clip). Based on the signal from the belt worn sensor 617, the controller 601 determines whether the device is being worn and the front display view is easily viewed by other or whether the device is not worn and presumably being held in the hand of the user. In the latter case, the controller 601 may be configured to assume that the device is positioned such that the front display view is only viewable by the user.

Also, although examples discussed herein refer to a device that includes a "belt clip" and that are configured to determine when the device is "belt worn," the device may in attached to the user for wearable use in various other ways using various other attachments. For example, the device may include an attachment that is configured to be selectively attachable to a lanyard or strap for wear on the chest of the user. Alternatively, the device may be insertable into a "holster" worn by the user. In such configurations, the "belt worn" sensor 617 would be replaced with a sensor configured to determine whether the device is inserted into the holster—for example, a light sensor or a contact sensor.

The orientation sensor 619 may include, for example, one or more accelerometers or gyroscopic sensor that determine whether the device is stationary (i.e., placed on a desk or attached to the belt of a person while standing still) or moving. Like the belt worn sensor 617, the information from the orientation sensor 619 can be used by the controller 601 to determine what information is appropriate to be shown on the front view display. The orientation sensor can also be used to determine the angle at which the display is currently positioned relative to the user or to others. This angle determination is then used to determine whether the top view display or the front view display are likely to be viewable by the user or by others and to determine an appropriate display output for the top display view and the front display view accordingly.

Furthermore, in some implementations, the controller 601 is configured to utilize information from both the belt worn sensor 617 and the orientation sensor 619 to determine what display information is appropriate. For example, if the belt worn sensor 617 indicates that the device is not attached to a belt (i.e., not "being worn"), but the orientation sensor 619 indicates that the device has not changed position or orientation for a defined period of time, the controller 619 may be configured to determine that the device has been placed on a table and the front view display could still be visible by non-users. Alternatively, if the belt worn sensor 617 indicates that the device is not attached to a belt and the orientation sensor 619 indicates that the device is moving, the controller 619 would conclude that the device is being held in the hand of the user and would display a message on the front view display that is appropriate for viewing by the user of the device.

In some implementations, the controller 601 is configured to use the output from the proximity sensor 621 positioned on a surface of the device housing to determine how close the device housing is to a surface. In some implementations, this information is used by the controller 601 to determine whether the device is being worn by the user (e.g., when the proximity sensor indicates that the device is positioned very close to a surface such as the user's chest). Furthermore, the controller 601 can apply a facial recognition algorithm to the output from the camera 623 to determine whether a viewer positioned at either the angle of the top display view 301 or the angle of the front display view 303 is an authorized user of the device.

When the device is being "worn" by a user (e.g., attached to a belt or a lanyard), display information provided on the front display view 301 of the display 107 might be easily seen by others. This may be problematic for some users—for example, police officers who may receive sensitive and confidential information on the display of their portable radio.

Therefore, the electronic device can be configured to provide display information through the front display view 301 that is either intended to be viewed by others or, at a minimum, does not need to remain confidential. The electronic device can also be configured to provide display information through the top display view 303 that is intended solely for the user of the electronic device. For example, in the case of a police officer, the front display view 301 can be used to display information identifying the user as a police officer including, for example, the officer's name or the name of the police department. Other types of display information that can be shown on the front display view 301 that is intended to be seen by others includes, for example, an indication that the device is recording video and/or audio, language translation, instructions to the public, team/on-scene accountability information for co-workers, role/capabilities of the user/wearer, and a visible locator beacon. At the same time, the top display view 303 can be used to provide emergency information that requires the officer's quick attention or to provide confidential information that should not be shared openly with passersby.

Figure 7:
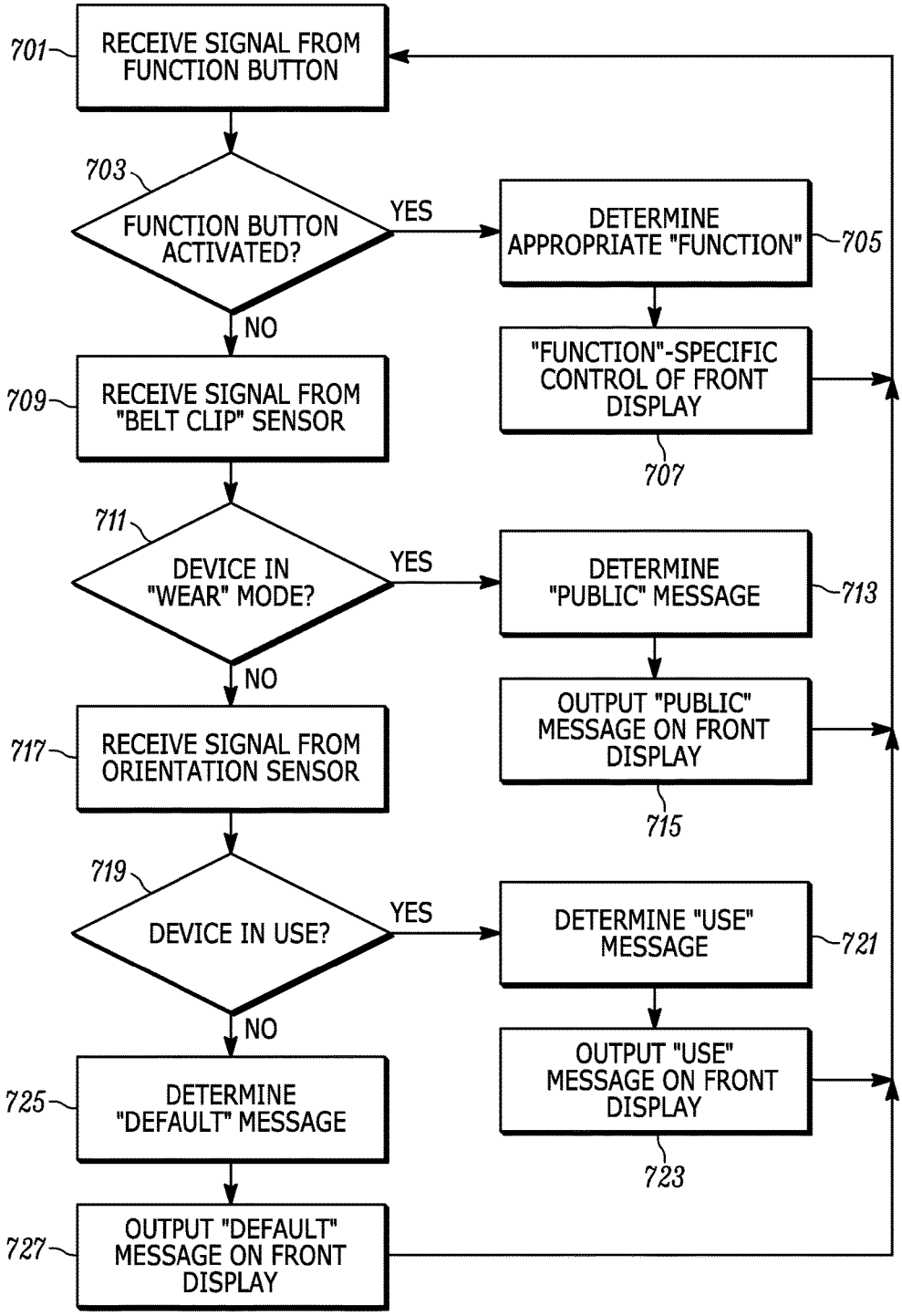
FIG. 7 is a flowchart of a method for controlling the display of the portable radio of FIG. 1 based on one or more sensed usage conditions in accordance with some embodiments.

FIG. 7 illustrates one example of a method implemented by the controller 601 for determining the appropriate display information to output on the front display view using signals and information provided by the buttons and sensors shown in FIG. 6. The controller 601 monitors the signal from the function button 615 at block 701. When the function button 615 has been activated at block 703, then the controller 601 determines the appropriate display output for that function at block 705 and provides the function-specific control output to the front display view at block 707. For example, when, as discussed above, the function button controls a "flash light" mode, the controller will cause the front-facing light-emitting diodes to turn on at high power when the function button is activated.

The controller 601 also monitors the signal from the belt worn sensor 617 at block 709 and, when the signal indicates that the device is being worn by the user at block 711, the controller 601 determines an appropriate "public" message at block 713 and causes that message to be displayed on the front display view at block 715. For example, as discussed above, the controller 601 could be configured to display a police officer's name and department on the front display view when the signal indicates that the device is being worn.

The controller 601 similarly monitors the signal from the orientation sensor 619 at block 717 and determines whether the device is likely "in use" (i.e., being handled by the user) at block 719. When the controller 601 determines that the device is likely "in use," the controller 601 determines an appropriate "in use" message at block 721 and outputs that message on the front display view at block 723. For example, in some embodiments, the controller 601 is configured to move display information from the top display view to the front display view when the orientation sensor 619 indicates that the device is "in use" and vice versa.

Finally, when the signals from the sensors and controls indicate that the function button has not been activated, the device is not being worn, and is also not being handled, the controller 601 determines an appropriate default message at block 725 and causes the default message to be displayed on the front display view at block 727.

Although the method illustrated in FIG. 7 specifically determines what display information to provide on the front display view, the same general method could be applied to determine an appropriate display output for the top display view. Furthermore, the priorities that govern the output message can be modified based on other use conditions or preferences. For example, in the case of a land mobile radio designed for use by police or other emergency personnel, the controller 601 may be configured to display a received emergency message immediately on the front display view, the top display view, or both regardless of the status of the various sensors and controls.

Furthermore, although the examples described above mention two specific orientations—a top view display and a front view display—the LED arrays can be oriented at other angles to provide view displays from different relative positions (i.e., a first perspective angle and a second perspective angle). Similarly, although the examples above include only two LED arrays that concurrently provide two different display views, other implementations can include even more LED arrays positioned and oriented in the same display field to provide a third, fourth, or even more simultaneous display views that are viewable from additional angles relative to the device housing.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A display for a portable electronic device, the display comprising:

a first set of light-emitting diodes positioned in a display field and oriented at a first angle to produce a first visual data depiction viewable at a first perspective angle; and a second set of light-emitting diodes co-positioned in the display field with the first set of light-emitting diodes, oriented at a second angle relative to the first angle to produce a second visual data depiction viewable at a second perspective angle, and to make the second visual data depiction non-viewable from the first perspective angle, the second perspective angle being different than the first perspective angle, and the second visual data depiction being different than the first visual data depiction.

2. The display of claim 1, wherein the first set of light-emitting diodes are arranged as a first two-dimensional array across the display field, and wherein the second set of light-emitting diodes are intermingled with the first set of light-emitting diodes across the display field and arranged in a second two-dimensional array.

3. The display of claim 2, further comprising:

a first plurality of carrier strips arranged in parallel across the display field, each carrier strip of the first plurality of carrier strips supporting a first defined number of linearly-arranged light-emitting diodes from the first plurality of light-emitting diodes; and a second plurality of carrier strips arranged alternatingly with the first plurality of carrier strips across the display field, each carrier strip of the second plurality of carrier strips supporting a second defined number of linearly-arranged light-emitting diodes from the second plurality of light-emitting diodes, and each carrier strip of the second plurality of carrier strips being positioned at an angle relative to a neighboring one of the first plurality of carrier strips, wherein the angle of each carrier strip of the second plurality of carrier strips provides the orientation of the second set of light-emitting diodes.

4. A portable electronic device, comprising a housing and the display of claim 1 positioned on a vertical side of the housing.

5. The portable electronic device of claim 4, wherein the first set of light-emitting diodes of the display are oriented such that the first visual data depiction is viewable at an angle normal to the vertical side of the housing, wherein the second set of light-emitting diodes of the display are oriented such that the second visual data depiction is viewable at an above angle relative to the vertical side of the housing, and wherein the second set of light-emitting diodes of the display are orient such that the second visual data depiction is not viewable at the angle normal to the vertical side of the housing.

6. The portable electronic device of claim 4, further comprising an attachment configured to selectively attach the portable electronic device to a user for wearable use, and wherein the second set of light-emitting diodes of the display are oriented such that the second visual data depiction is viewable by the user during wearable use.

7. The portable electronic device of claim 4, further comprising a controller communicatively coupled to the display and configured to provide display signal information to the first set of light-emitting diodes and the second set of light-emitting diodes causing the display to produce the first visual data depiction and the second visual data depiction.

8. A method for controlling a display of a portable electronic device, the method comprising:

providing a first set of display data to a first set of light-emitting diodes positioned in a display field and oriented at a first angle to produce a first visual data depiction viewable at a first perspective angle based on the first set of display data; and providing a second set of display data to a second set of light-emitting diodes co-positioned in the display field with the first set of light-emitting diodes, oriented at a second angle relative to the first angle to produce a second visual data depiction viewable at a second perspective angle based on the second set of display data, and oriented to make the second visual data depiction non-viewable from the first perspective angle, the second perspective angle being different than the first perspective angle, and the second visual data depiction being different than the first visual data depiction.

9. The method of claim 8, further comprising:

receiving, by a controller, a signal from a sensor, the signal being indicative of a specific usage condition;

determining, by the controller, display information for the first visual data depiction based on the received signal; and changing the first visual data depiction based on the determined display information.

10. The method of claim 9, wherein receiving the signal from the sensor includes receiving a signal from a sensor indicative of whether the portable electronic device is being worn by a user.

11. The method of claim 9, wherein receiving the signal from the sensor includes receiving a signal from a function button mounted on a housing of the portable electronic device, and wherein changing the first visual data depiction includes turning on all of the light-emitting diodes in the first plurality of light-emitting diodes at a high power level.

12. The method of claim 9, wherein receiving the signal from the sensor includes receiving a signal indicating that the portable electronic device is moved from a first placement where the display is viewable by a user from the second perspective angle to a second placement where the display is viewable by the user from the first perspective angle, and wherein changing the first visual data depiction includes displaying the second visual data depiction on the first plurality of light-emitting diodes.

13. The method of claim 12, wherein receiving the signal indicating that the portable electronic device is moved from the first placement to the second placement includes receiving a signal from a sensor configured to monitor whether the portable electronic device is attached to the user for wearable use, the signal indicating that the portable electronic device had previously been attached to the user for wearable use and is no longer attached to the user for wearable use.

14. The method of claim 13, wherein receiving the signal indicating that the portable electronic device is moved from the first placement to the second placement further includes receiving a second signal from an orientation sensor indicating movement of the portable electronic device while the portable electronic device is no long attached to the user for wearable use.

15. The method of claim 8, wherein providing the first set of display data to the first set of light-emitting diodes includes providing display data for a public view message to be shown as the first visual data depiction viewable at the first perspective angle, and wherein providing the second set of display data to the second set of light-emitting diodes includes providing display data for a private view message to be shown as the second visual data depiction viewable at the second perspective angle.

16. The method of claim 8, wherein the first perspective angle includes an angle viewable by others when the portable electronic device is being worn by a user, and wherein the first visual data depiction includes a message selected from a group consisting of an identification of a user associated with the portable electronic device, an indication that the portable electronic device is recording video or audio, a language translation, and a public instruction message.

* * * * *